US005513297A

United States Patent [19]

Kleijn et al.

[11] Patent Number: 5,513,297

[45] Date of Patent: Apr. 30, 1996

[54] SELECTIVE APPLICATION OF SPEECH CODING TECHNIQUES TO INPUT SIGNAL SEGMENTS

[75] Inventors: Willem B. Kleijn, Basking Ridge; Peter Kroon, Green Brook, both of N.J.

[73] Assignee: AT&T Corp., Murray Hill, N.J.

[21] Appl. No.: 911,850

[22] Filed: Jul. 10, 1992

[51] Int. Cl.[6] ..... G10L 9/00

[52] U.S. Cl. ..... 395/2.32; 395/2.31; 395/2.29

[58] Field of Search ..... 381/32, 34, 36, 381/40, 37, 38, 39; 395/2.28–2.32, 2.38, 2, 2.1, 2.39

[56] References Cited

U.S. PATENT DOCUMENTS

| | | | |
|---|---|---|---|
| 4,896,362 | 1/1990 | Veldhuis et al. | 395/2.38 |
| 4,910,781 | 3/1990 | Ketchum et al. | 395/2.32 |
| 4,956,871 | 9/1990 | Swaminathan | 395/2.31 |
| 5,091,955 | 2/1992 | Iseda et al. | 381/36 |
| 5,115,469 | 5/1992 | Taniguchi et al. | 381/34 |
| 5,195,137 | 3/1993 | Swaminathan | 381/32 |
| 5,224,167 | 6/1993 | Taniguchi et al. | 381/36 |
| 5,233,660 | 8/1993 | Chen | 381/36 |
| 5,271,089 | 12/1993 | Ozawa | 395/2.31 |

OTHER PUBLICATIONS

T. W. Parsons, *Voice and Speech Processing,* McGraw–Hill, New York, NY, 1987, p. 234.

A. Gersho et al., "Vector Quantization: A Pattern Matching Technique for Speech Coding," *IEEE Communications Magazine,* Dec. 1983, pp. 15–21.

J. Makhoul et al "Vector Quantization in Speech Coding," *Proceedings of the IEEE,* Nov. 1985, 73(11):1551–88.

Kleijn et al., "A 5.85 kb/s CELP Algorithm for Cellular Applications," ICASSP–94, Apr. 27–30, 1993, pp. 596–99.

Kroon et al., "Strategies for Improving the Performance of CELP Coders at Low Bit Rates," ICASSP–88, Apr. 11–14, 1988, pp. 151–154.

Peter Kroon and Bishnu S. Atal, "Predictive Coding of Speech Using Analysis–by–Synthesis Techniques," in *Advances in Speech Signal Processing (eds. Sakaoki Furui and M. Mohan Sondhi), Marcel Dekker, Inc., New York, NY (Sep. 27, 1991), pp. 141–164.*

D. K. Freeman et al. "The Voice Activity Detector for the Pan–European Digital Cellular Mobile Telephone Service, "Proceedings of ICASSP, vol. 1, 369–372 (1989).

J. A. Sciulli et al. "Speech Predictive Encoding Communication System for Multichannel Telephony," IEEE Transactions on Communictions, vol. COM–21, No. 7, 827–835 (Jul. 1973).

M. Honda and F. Itakura, "Bit Allocation in Time and Frequency Domains for Predictive Coding of Speech," *IEEE Transactions on Acoustics, Speech, and Signal Processing,* vol. ASSP–32, No. 3, 465–473 (Jun. 1984).

*Primary Examiner*—Allen R. MacDonald
*Assistant Examiner*—Michael A. Sartori
*Attorney, Agent, or Firm*—Thomas A. Restaino

[57] ABSTRACT

A speech coding method and apparatus which selectively applies speech coding techniques to time segments of speech information signals, such as, e.g., pitch cycle waveforms is disclosed. A speech information signal comprising N signal segments is coded with a first speech coder to provide a first coded representation for each of the N signal segments. A second speech information signal reflecting speech information not coded by the first coder is determined for each of one or more of the N signal segments. In addition to coding the N first speech information signal segments with the first speech coder, M of the second speech information signals are coded with a second speech coder, where $1 \leqq M \leqq N-1$. The selective coding of M of the second speech information signals is done responsive a coding criterion. By selective use of the second speech coder, the number of bits needed to represent speech information may be reduced, or alternatively, better performance may be obtained without an increase in bit rate. The first and second speech coders may be any of those known in the art.

22 Claims, 3 Drawing Sheets

SELECTIVE APPLICATION OF SPEECH CODING TECHNIQUES TO INPUT SIGNAL SEGMENTS

FIELD OF THE INVENTION

The present invention relates generally to speech communication systems and more specifically to coding techniques for speech compression.

BACKGROUND OF THE INVENTION

Efficient communication of speech information often involves the coding of speech signals for transmission over a channel or network ("channel"). Speech coding systems include coding processes which convert speech signals into codewords for transmission over the channel and decoding processes which reconstruct speech from received code words. These coding and decoding processes provide data compression and expansion useful tier communication of speech signals over channels of limited bandwidth.

In analysis-by-synthesis speech coding systems, such as code-excited linear predictive (CELP) speech coding known in the art, a speech signal for coding is first divided into contiguous time segments of fixed duration referred to as subframes. Each subframe is typically 2.5 to 7.5 milliseconds (ms) in duration. Most of the speech information of each subframe is coded as a set of parameters characterizing the speech signal within the subframe. Several contiguous coded subframes (usually 4 or 6) are collected together in groups referred to as frames. These frames of coded speech are communicated via a channel to a receiver. The receiver may, e.g., synthesize audible speech from the received frame information.

A goal of most speech coding systems is to provide faithful reproduction of original speech sounds such as, e.g., voiced speech, produced when the vocal cords are tensed and vibrating quasi-periodically. In the time domain, a voiced speech signal usually appears as a succession of similar but slowly evolving waveforms referred to as pitch-cycles. A pitch-cycle waveform is generally characterized by a major transient surrounded by a succession of lower amplitude vibrations. A single one of these pitch-cycle waveforms has a duration referred to as a pitch-period.

Because of the nature of the voiced speech signal pitch-cycle, speech coding systems which operate on a subframe basis aim to accurately represent widely disparate signal features within a subframe. How these speech signal features are treated by a speech coding system significantly affects system performance.

SUMMARY OF THE INVENTION

The present invention provides a speech coding method and apparatus which selectively applies speech coding techniques to time segments of speech information signals, such as, e.g., pitch-cycle waveforms. A speech information signal comprising N signal segments is coded with a first speech coder to provide a first coded representation for each of the N signal segments. A second speech information signal reflecting speech information not coded by the first coder is determined for each of one or more of the N signal segments. In addition to coding the N first speech information signal segments with the first speech coder, M of the second speech information signals are coded with a second speech coder, where $1 \leqq M \leqq N-1$. The selective coding of M of the second speech information signals is done responsive a coding criterion. By selective use of the second speech coder, the number of bits needed to represent speech information may be reduced, or alternatively, better performance may be obtained without an increase in bit rate. The first and second speech coders may be any of those known in the art.

Illustrative embodiments of the present invention provide improved CELP speech coding systems. Such improved CELP systems are adapted to provide for subframes of 2.5 ms in duration. These subframes serve as the segments referenced above. Given their short duration, many subframes of a speech information signal will not contain a major signal transient. The illustrative embodiments provide coding for all subframes with the first speech coder. For those subframes without a major transient, such coding may be all that is required to satisfy an applicable coding criterion, such as a threshold signal energy For those segments which include a major transient, additional coding may be employed to meet the applicable criterion. In this way, speech information signal coding is tailored on a subframe basis to meet coding requirements as needed.

In a first illustrative embodiment of the present invention, the selection of second speech information signals for coding with a second speech coder is based upon the coding criterion. In a second illustrative embodiment, the coding of second speech information signals involves coding several trial combinations of second speech information signals and selecting one of the combinations based on a coding criterion.

DETAILED DESCRIPTION

A. Introduction to the Illustrative Embodiments

Figure 1:
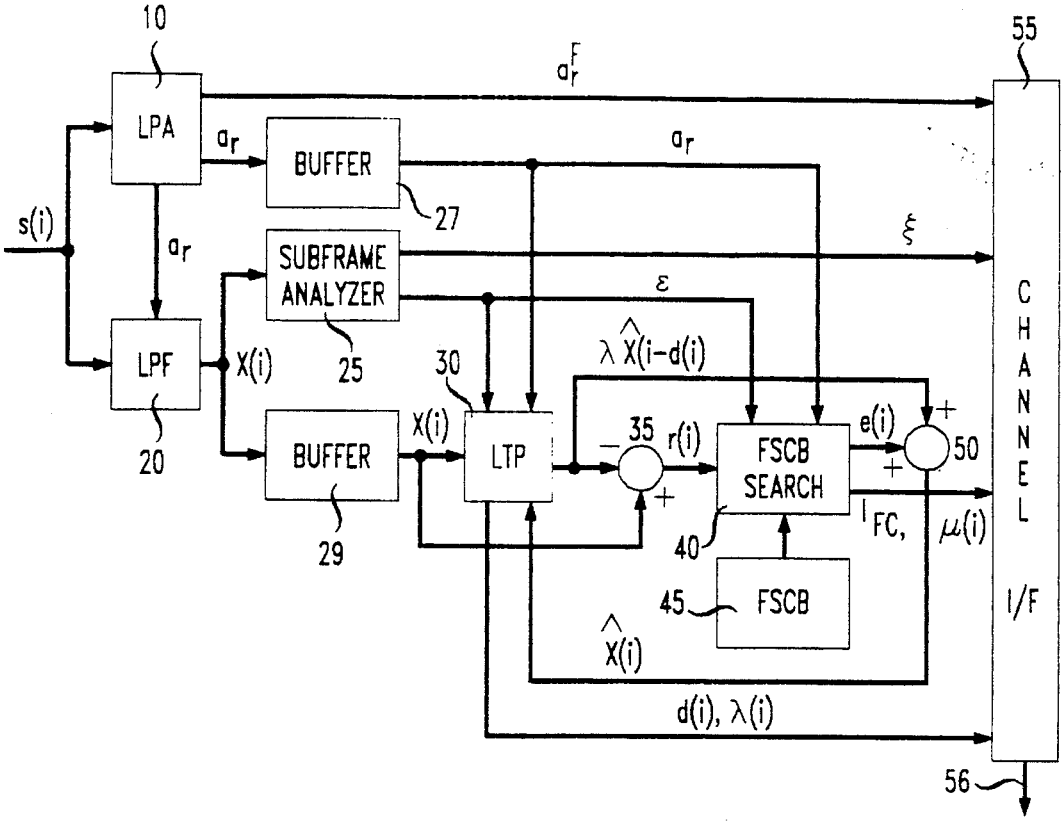
FIG. 1 presents a first illustrative embodiment of the present invention.

For clarity of explanation, the illustrative embodiments of the present invention are presented as comprising, among other things, individual functional blocks. The functions these blocks represent may be provided through the use of either shared or dedicated hardware, including, but not limited to, hardware capable of executing software. Illustrative embodiments may comprise digital signal processor (DSP) hardware, such as the AT&T DSP16 or DSP32C, and software performing the operations discussed below. Very large scale integration (VLSI) hardware embodiments of the present invention, as well as hybrid DSP/VLSI embodiments, may also be provided.

The illustrative embodiments of the present invention provide an improvement to conventional CELP speech coding. Because the embodiments are directed to an improvement of CELP, those aspects of the embodiments ordinarily found in conventional CELP will not be discussed in great detail. For a discussion of conventional CELP and related topics, see commonly assigned U.S. patent application Ser. No. 07/782,686, which is hereby incorporated by reference as if set forth fully herein. In light of this incorporated disclosure and the discussion to follow, it will be apparent to those of ordinary skill in the art that the present invention is applicable to various other speech coding systems, not merely analysis-by-synthesis coding systems generally, or CELP coders specifically.

The illustrative embodiments of the present invention concern selective application of two speech coders. The first speech coder comprises a long term predictor (LTP) (either alone or in combination with a linear predictive filter (LPF)). The second comprises a fixed stochastic codebook (FSCB) and search mechanism. As in conventional CELP, the embodiments code subframes of a speech information signal. These subframes are packaged together in conventional fashion as a frame of coded speech information and communicated to a receiver. Each frame is 20 ms in duration and comprises eight 2.5 ms subframes of speech information.

The illustrative embodiments provide coding for voiced speech signals. Coding for other types of speech signals, e.g., silence and unvoiced speech, may be provided by conventional coding techniques known in the art. Switching between such coding techniques and embodiments of the present invention may also be accomplished by conventional techniques known in the art. See, e.g., commonly assigned U.S. Pat. No. 5,007,093, which is hereby incorporated by reference as if fully set forth herein. For the sake of the clarity of explanation of the present invention, these well understood techniques will not be presented further.

Communication channels for use with embodiments of the present invention may comprise, e.g., a telecommunications network, such as a telephone network or radio link, or a storage medium, such as a semiconductor memory, magnetic disk or tape memory, or CD-ROM (combinations of a network and a storage medium may also be provided). Within the context of the present invention, a receiver is any device which receives coded speech signals over the communications channel. So, e.g., a receiver may comprise a CD-ROM reader, a dish or tape drive, a cellular or conventional telephone, a radio receiver, etc. Thus, the communication of signals via the channel may comprise, e.g., signal transmission over a network or link, signal storage in a storage medium, or both.

B. A First Illustrative Embodiment

A first illustrative embodiment of the present invention is presented in FIG. 1. As shown in the Figure, a sampled speech information signal, s(i), (where i is the sample index) is provided to a linear predictive filter 20 and a linear predictive analyzer 10. Signal s(i) may be provided, e.g., by conventional analog-to-digital conversion of an analog speech signal. Linear predictive analyzer (LPA) 10 computes linear prediction coefficients in the conventional fashion well known in the art based on the signal s(i). The coefficients are determined and quantized by LPA 10 to be valid at frame boundaries, as in conventional CELP. Coefficient values, $\alpha_r$, valid at the center of subframes within the boundaries are determined by conventional interpolation of quantized frame boundary coefficient data by LPA 10. The coefficients, $\alpha_r$, valid at subframe centers are output to buffer 27 and LPF 20. Coefficients valid at frame boundaries, $\alpha_r^F$, are additionally output to channel interface 55. Values of $a_r$ valid at the center of subframes are used by LPF 20 and, via buffer 27, adaptive codebook and search (ACB&S) 30 and FSCB search 40, in the conventional manner.

Signal x(i)—the first speech information signal of the illustrative embodiment—is foraged in the conventional manner by LPF 20 based on coefficients provided by LPA 10. Two subframes of signal x(i) are provided by LPF 20, one subframe (i.e., 20 samples) at a time, by the filtering of successive samples of LPF 20 input signal s(i) as follows:

$$x(i) = s(i) - \sum_{r=1}^{R} a_r s(i-r), \tag{1}$$

where linear prediction coefficients $\alpha_r$ are valid at the center of the subframe in question. Since R is usually about 10 samples (for an 8 kHz sampling rate), the signal x(i) retains the long-term periodicity of the original signal, s(i). ACB&S 30, discussed below, is provided to remove this redundancy.

Subframes of signal x(i) are output from LPF 20 and are provided to subframe analyzer 25 and buffer 29. Analyzer 25 and buffer 29 each store pairs of subframes of the information signal x(i) provided by LPF 20. In accordance with the present invention, subframe analyzer 25 determines, for each pair of subframes it has stored, which subframe should be coded with use of the first coder only (i.e., the ACB&S 30), and which should be coded with use of both the first and second coders (i.e., the ACB&S 30 and the FSCB system 40, 45). This determination is based on the speech information signal energy of each subframe of the pair. The subframe which exhibits the greater signal energy is chosen by analyzer 25 for coding with use of both the first and second speech coders. The other subframe—the one with less signal energy—is coded with use of the first speech coder, but not the second. Subframe energy is determined by analyzer 25 in conventional fashion:

$$E = \sum_{l=1}^{L} x^2(l), \tag{2}$$

where L is the number of samples in a subframe (e.g., L=20 samples).

Subframe energy is determined by analyzer 25 for each subflame of a subframe pair prior to coding either of the two subframes. Once the determination of subframe energy has been made, the subframes of the pair in question may be coded in turn. Copies of these subframes are stored in buffer 29, as discussed above, for the purpose of coding by the embodiment. Linear prediction coefficients from analyzer 10 needed for coding these buffered subframes are stored in buffer 27.

Buffers 27, 29 do not acid coding delay to the system. This is because ordinary linear prediction analyzers and filters, e.g., LPA 10 and LPF 20, must themselves collect and store speech information signal values in order to determine linear prediction coefficients and filtered speech information. In one conventional form of linear prediction analysis, the LPA 10 stores one-half frame of speech information signal samples on each side of a frame boundary at which linear prediction coefficients are to be computed. Therefore, prior to determining linear prediction coefficients valid at the center of the first subframe of a given frame, the conventional LPA 10 introduces a delay of one and one-half frames. Since samples (e.g., whole subframes) of speech information signals must be stored for the computation of these linear prediction coefficients, the storage of subframes in buffer 27 may be implemented as a block transfer of information which can occur without sample delay. Thus, no delay need be introduced by virtue buffer 27, 29 storage.

Analyzer 25 controls the coding of the pair subframes stored in buffer 29 by the generation of an enable signal, $\epsilon$, which it provides to the coders. Once $\epsilon$ is appropriately asserted, the subframes of a buffered subframe pair are coded, one at a time, by application of the first coder—the ACB&S 30.

The ACB&S 30 of the illustrative embodiment comprises a conventional CELP adaptive codebook and search mechanism which determines a gain $\lambda(i)$ and a delay d(i) (although indexed by i, values for d(i) and $\lambda(i)$ are constant for all samples within a subframe). ACB&S 30 will be enabled to operate when $\epsilon$ takes on a value other than 00 (see discussion of $\epsilon$ below). Computed values for delay and gain for each coded subframe are provided by ACB&S 30 to channel interface 55 as shown in FIG. 1. A subframe of a residual speech information signal, r(i), —the second speech information signal of the embodiment—is determined as follows:

$$r(i)=x(i)-\lambda(i)\hat{x}(i-d(i)), \tag{3}$$

where the $\hat{x}(i-d(i))$ are samples of a speech information signal synthesized (or reconstructed) in earlier subframes. To facilitate implementation of (3), ACB&S 30 provides the quantity $\lambda(i)\hat{x}(i-d(i))$ to subtraction circuit 35. Signal r(i) is the speech information signal remaining alter $\lambda(i)\hat{x}(i-d(i))$ is subtracted from x(i) by circuit 35; r(i) reflects speech information not coded by the first speech coder. Signal r(i) may then coded with a FSCB mechanism 40 under the control of subframe analyzer 25 by enable signal, $\epsilon$.

The enable signal, $\epsilon$, is provided by analyzer 25 to the fixed stochastic codebook (FSCB) search mechanism 40 to control application of the FSCB to the subframe of a pair of subframes determined to contain the greater energy. The enable signal, $\epsilon$, may be implemented with two bits. So, e.g., when the bits forming $\epsilon$ are 01, the FSCB system 40, 45 codes the first (or earlier) subframe of a subframe pair. When the bits forming $\epsilon$ are 10, the FSCB system 40, 45 codes the second subframe of the pair ($\epsilon$ equalling 00 indicates a wait or idle state for both coders commensurate with speech information signal buffering).

When the enable signal is asserted (as either a 01 or 10), the FSCB search mechanism 40 operates to determine a vector from the FSCB 45 and a scaling factor, $\mu(i)$, which in combination most closely match the signal r(i) associated with the subframe to be coded. The FSCB 45 and search mechanism 40 are conventional in the art except for the control provided by the analyzer 25. FSCB mechanism 40 provides as output to channel interface 55 an index indicating the determined FSCB vector, $I_{FC}$, and an associated scaling factor, $\mu(i)$. When the enable signal from analyzer 25 is not asserted (i.e., $\epsilon$ is 00), the FSCB mechanism 40 sits idle.

Analyzer 25 also provides to channel interface 55 a single bit for each pair of subframes processed by the embodiment of FIG. 1. This bit, referred to as the subframe selection bit, $\xi$, reflects the asserted value of $\epsilon$ supplied to FSCB 40. When $\epsilon$ is set to 01, the subframe selection bit $\xi$ is set to 0. When $\epsilon$ is set to 10, $\xi$ is set to 1. Channel interface 55 requires a subframe selection bit $\xi$ for each pair of coded subframes to provide an indication of which subframes has been coded with both coders and which has not.

Once coding of the two subframes of a subframe pair is complete, coding is halted until analyzer 25 has determined how to code the next successive pair of subframes. Analyzer 25 halts coding by providing $\epsilon$ equal to 00. First and second coders operate responsive to the asserted $\epsilon$ signal and then check $\epsilon$ when done. If $\epsilon$ equals 00, they halt; otherwise they proceed to code the next pair of subframes as described above.

Figure 2:
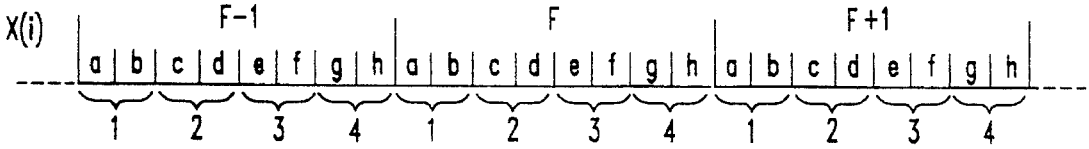
FIG. 2 presents three contiguous frames of a speech information signal x(i).

FIG. 2 is provided to facilitate an understanding of how the analyzer 25 and the buffers 27 and 29 operate over time with the other components of the illustrative embodiment of FIG. 1. FIG. 2 presents contiguous frames of the speech information signal x(i). These frames are provided to analyzer 25 for energy determinations (actual sample values for signal x(i) are not shown for the sake of clarity). As shown in the Figure, each of the frames, F−1, F, and F+1, comprises eight subframes, labeled a through h. Since each frame comprises 160 samples (or 20 ms of speech information at 8 kHz sampling rate), each of the labeled subframes comprises 20 samples (or 2.5 ms of speech information). Consecutive pairs of subframes within each frame are numbered 1 through 4.

Assume that a signal, s(i), has been provided to LPA 10 and LPF 20 of FIG. 1 as is conventional in CELP coders. As a result, LPA 10 has determined LP coefficients valid at the frame boundaries between frames F−1 and F, (i.e., $a_r^{F-1}$), and F and F+1 (i.e., $a_r^{F}$). These coefficients are used in a conventional interpolation process by LPA 10 to provide subframe coefficients as discussed above. These subframe coefficients are used by LPF 20 in conventional fashion to filter subframes of signal s(i).

At the outset, two subframes of signal s(i) are filtered by LPF 20 to yield the first pair subframes of signal x(i) in frame F: subframes a and b (i.e., frame F, pair 1). Analyzer 25 and buffer 29 receive and store subframes a and b of frame F. The enable signal bits provided by analyzer 25 are set to 00, reflecting an idle state of the coding system. Analyzer 25 determines which of subframes a and b contains the greater amount of energy as discussed above. Responsive to this determination, analyzer 25 controls the coding of subframes a and b by the first and second coders. As part of this control process, analyzer 25 provides an enable signal, $\epsilon$, indicating which of the two subframes is to be coded with both coders.

Once the enable signal is provided, coding occurs as described above. Analyzer 25 can then reset enable signal to 00. Analyzer 25 and buffer 29 proceed to store the next contiguous pair of subframes—frame F, subframe pair 2, comprising subframes c and d. Control of the coding of subframes c and d responsive to this determination is thereafter effected by analyzer 25.

The determination of subframe energy and control of coders is repeated for each consecutive pair of subframes in the speech information signal. So, for example, after coding subframes c and d, the embodiment of FIG. 1 proceeds to code subframes e and f (i.e., pair 3), and subframes g and h (i.e., pair 4) of frame F. As a result of coding only one subframe of each consecutive subframe pair with the second coder, the second coder has been used to code only 4 of the 8 subframes in frame F. At this point, LPA 10 computes additional frame boundary linear prediction coefficients (e.g., coefficients valid at the right boundary of frame F+1, $a_r^{F+1}$) and the whole process repeats itself, from one frame to the next, for as long as there are signal subframes to code.

Figure 7:
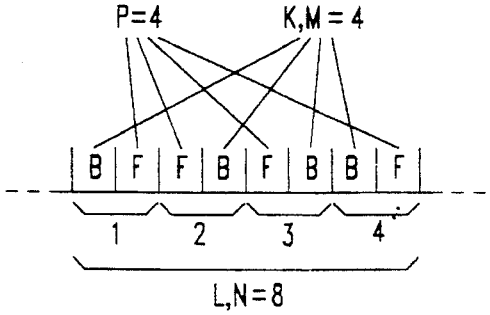
FIG. 7 presents an illustration of certain quantities relating to the number of subframes coded in accordance with the principles of the present invention

FIG. 7 presents an illustration of certain quantities relating to the number of subframes coded in accordance with the principles of the present invention. FIG. 7 depicts an illustrative frame of 8 subframes, such as frame F of FIG. 2. Each subframe is coded with use of a first speech coder while only one subframe from each of the 4 pairs of subframes is coded with use of both the first and second speech coders. The letter "F" indicates a subflame coded with use of the first speech coder only while the letter "B" indicates a subframe coded with use of both speech coders. In this example, there are N=8 subframes of the frame F which are to be coded. There are P=4 subframes coded with use of the first speech coder (and not the second). There are M=4 subframes coded with use of both speech coders. Said alternatively, there are L=8 subflames coded with use of the first coder (whether with or without the second coder), and K=4 subframes coded with use of the second speech coder (whether with or without the first coder).

Over the course of coding eight subframes of a frame of speech, information representative of each coded speech subframe is collected by channel interface 55 for transmission to a receiver over a channel 56. The receiver uses this information in the reconstruction of speech. This information comprises ACB&S parameters $\lambda(i)$ and d(i), the FSCB index, $I_{FC}$, and scaling factor, $\mu(i)$ (for the appropriate higher energy subframes), and the linear prediction coefficients $a_r$, valid at the later of the two frame boundaries associated with the coded frame, e.g. $a_r^F$. This information further comprises a set of subframe selection bits, $\xi$, identifying which subframe in each successive pair of coded subframes has been coded with use of both coders. Channel interface 55 buffers all information it receives during the coding of a frame and maps (or assembles) the buffered information into a format suitable for communication over channel 56.

Figure 3:
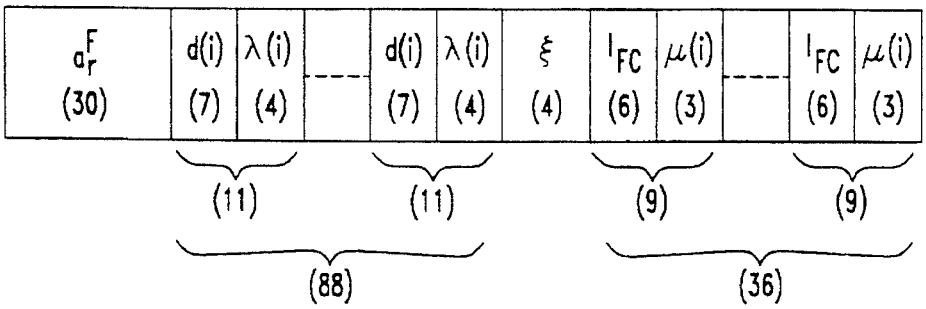
FIG. 3 presents an illustrative bit format for one frame of coded speech information.

FIG. 3 presents an illustrative format of a frame of coded speech information as assembled by interface 55. This format comprises 158 bits which ,are partitioned among various quantities needed by a receiver to reconstruct a frame of speech. These quantities include ACB&S 30 information (i.e., delay and gain) for all eight subframes of the frame, and FSCB system 40, 45 information (i.e., codebook index and gain) for four of the eight subframes.

As shown in the Figure, linear prediction coefficients, $a_r$, $1 \leqq r \leqq 10$, are represented by a field of 30 bits. These 30 bits are used to represent the coefficients in the conventional fashion well known in the art.

Also represented is ACB&S delay and gain information for each of the eight subframes of a coded frame. Each subframe's ACB&S delay, d(i), is represented by a 7 bit field. Each subframe's ACB&S gain, $\lambda(i)$, is represented by a 4 bit field. Therefore, a total of 88 bits (i.e., 8 subframes×(7 bits+4 bits)) are used to represent coded speech information provided by the first coder—the ACB&S 30.

As an alternative to coding each delay of a frame with 7 bits, either the fourth or the fifth subframe delay of may be coded with 7 bits and the other seven subframe delays may be coded differentially, using 2 bits per subframe differential delay value. This practice saves a total of 35 bits, reducing the number of bits required to code a frame from 158 to 123.

As a further alternative to coding multiple delay values (whether differential or otherwise) for each frame, the present invention may be combined with the generalized analysis-by-synthesis techniques disclosed in U.S. patent application Ser. No. 07/782,686 and incorporated by reference above. By virtue of combining the present invention with the techniques of the referenced application, delay information need be sent only once for each coded frame. Thus, e.g., only seven bits need be used to represent delay for the entire frame. This provides a savings of an additional 1.4 bits. To combine tile techniques of the referenced application with those of the present invention, the embodiments presented in FIGS. 3 and 5 of the referenced application may each be modified to buffer signal x(i) and parameters M and $a_n$ while subframe analysis is performed in accordance with the first illustrative embodiment of tile present invention. Alternatively, embodiments presented in FIGS. 3 and 5 may each be used as coding subsystems in accordance with the second illustrative embodiment of the present invention (see below).

FIG. 3 further shows a 4 bit subframe selection field which contains a subframe selection bit, $\xi$, for each of four contiguous pairs of subframes coded. Each of these four bits represents one of the four subframe pairs. As stated above, a zero-valued selection bit indicates the first (i.e., the earlier) of two subframes of a subframe pair has been coded with use of both coders, while a one-valued selection bit indicates the second (i.e., the later) of two such subframes has been so coded.

After the four bits designated for subframe selection, the channel format includes a field for the representation of FSCB system 40, 45 information. The bits of this field are divided among the four subframes identified by the subframe selection bit field. For each such identified subframe, a FSCB index, $I_{FC}$ (6 bits), and a FSCB scaling factor, $\mu(i)$ (3 bits), are communicated. Thus, the field comprises 36 bits (4 subframes×(3 bits+6 bits)).

A frame of coded speech information in the format described above is communicated over communication channel 56 to a receiver. The receiver reconstructs or synthesizes a frame of speech information from the coded frame. An illustrative embodiment of a receiver tier synthesizing speech information according to the present invention is presented in FIG. 4.

Figure 4:
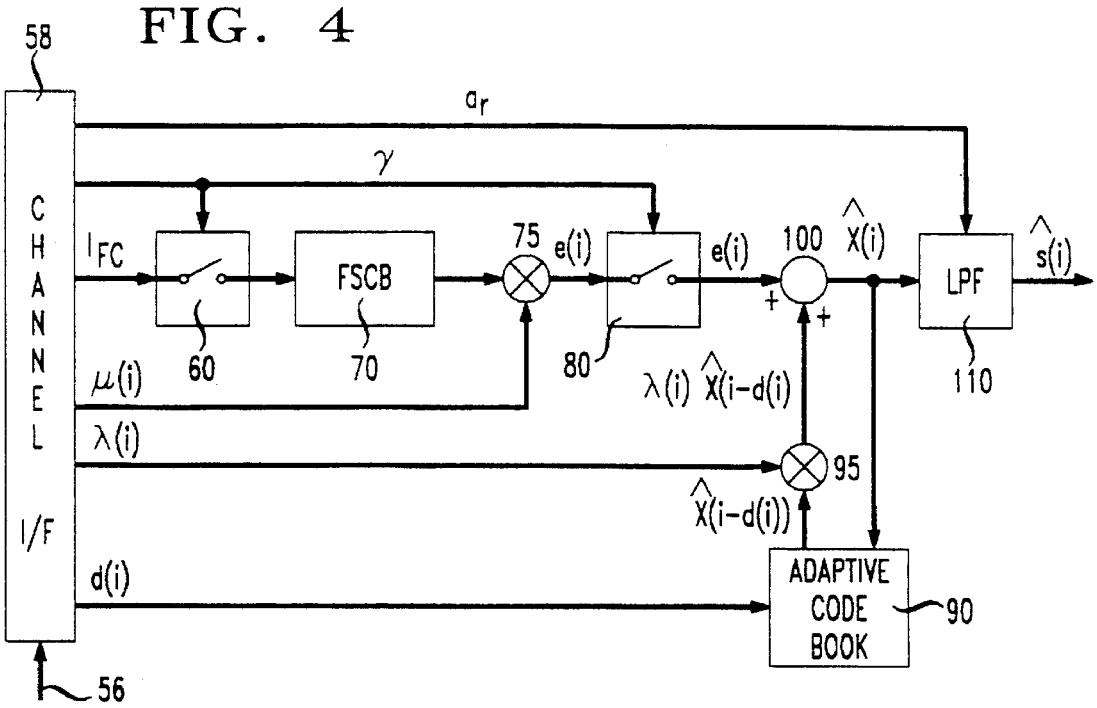
FIG. 4 presents an illustrative embodiment of a receiver for use with the illustrative embodiment of FIG. 1.

As a general matter, the receiver of FIG. 4 performs the inverse of the coding process discussed above. Successive frames of coded speech information transmitted by channel interface 55 are received by receiver channel interface 58. Interface 58 unpacks the bits of a received coded frame format and provides appropriate information and signals to other elements of the receiver.

Assume that a frame of coded speech information has been received by channel interface 58 and that this frame represents frame F presented in FIG. 2. Responsive to receipt of this coded frame, channel interface extracts linear prediction coefficients, $a_r^F$, from the received frame. Recall that these coefficients are valid at the latest frame boundary (,that is, the frame boundary which lies at the end of frame F). These coefficients are used, together with the set of previously received and stored linear prediction coefficients valid at previous frame boundary (the frame boundary which lies at the end of frame F–1, $a_r^{F-1}$), to provide a set of coefficients valid at the center of each subframe of speech within frame F. These sets of coefficients are provided with conventional linear prediction coefficient interpolation well known in the art. Naturally, the set of linear prediction coefficients received by interface 58, ahd $r^F$, will be buffered for use in a subsequent interpolation process. This subsequent interpolation process will be performed in response to the receipt on the next frame of coded speech information, frame F+1. The process of buffering and interpolation is repeated tier each frame of coded speech received by interface 58.

After interpolating linear prediction coefficients, the receiver proceeds to synthesize the subframes of coded speech. Interface 58 extracts from the received frame the subframe selection bit $\xi$ associated with the first pair of coded subframes, a and b, of frame F. The interface 58 examines $\xi$ to determine whether the synthesis of the first subframe of speech information (i.e., subframe a of frame F) requires application of the FSCB 70. If so, interface 58 provides a logically true subframe selection control signal, $\gamma$, to switches 60 and 80 of the receiver. Signal $\gamma$ asserted as true causes the switches 60, 80 to be in a closed state effectively coupling the FSCB 70 into the synthesis process for subframe a. If no application of FSCB 70 is required for subframe a, interface 58 provides a logically false $\gamma$ to switches 60 and 80, causing switches 60 and 80 to open, effectively decoupling the FSCB 70 from the synthesis process.

After determining the appropriate subframe selection control signal $\gamma$, interface 58 may extract and output to switch 60 the fixed codebook index, $I_{FC}$, associated with the subframe of the first subframe pair which has been coded with use of the FSCB system 40, 45. Also, interface 58 may extract and provide to multiplier circuit 75 the FSCB gain, $\mu(i)$, for that subframe.

Assuming that subframe a is the subframe of the first pair coded with both coders, signal $\gamma$ will be true and switches 60 and 80 will be closed. Index, $I_{FC}$, and gain, $\mu(i)$, provided will be used by FSCB 70 and multiplier 80, respectively, to provide a synthesized excitation signal, e(i), in the conventional fashion. This excitation signal, e(i), is the contribution of the FSCB system 70, 75 to a synthesized speech information signal or subframe a. The excitation signal e(i) is provided to summing circuit 100 for addition to the adaptive codebook contribution to the synthesized speech information signal for that subframe.

This adaptive codebook contribution is provided based on the extracted adaptive codebook delay and gain information, d(i) and $\lambda(i)$, respectively, associated with subframe a of coded speech. The adaptive codebook contribution is determined in the conventional fashion, with the delay, d(i), serving to identify a previously synthesized frame of speech information, and the gain $\lambda(i)$ acting as a multiplicative factor.

Synthesis of speech for subframe a is completed by an inverse LPF 110 based on linear prediction coefficients provided by interface 58. These coefficients are valid at the center of subframe a.

Since subframe a of the first pair of subframes was coded with use of both coders, it follows that subframe b was coded without the FSCB system 40, 45. Therefore, to proceed with the synthesis of speech for subframe b, interface 58 must apply a logically false subframe selection control signal $\gamma$ to switches 60 and 80. By doing this, interface 58 causes FSCB system 70, 75 to play no part in the synthesis of speech for this subframe. Speech associated with subframe b is therefore synthesized with use of the adaptive codebook 90 and gain multiplication circuit 95, along with the inverse LPF 110. As a result of switch 80 being open, excitation signal e(i) is zero valued.

Consecutive pairs of coded subframes of speech are handled in the same manner as subframes a and b. Of course, other subframe pairs may have been coded differently (that is, with the first of the two subframes coded without the FSCB system 40, 45). In such a circumstance, the procedures discussed above for subframes a and b would be reversed.

C. A Second Illustrative Embodiment

Figure 5:
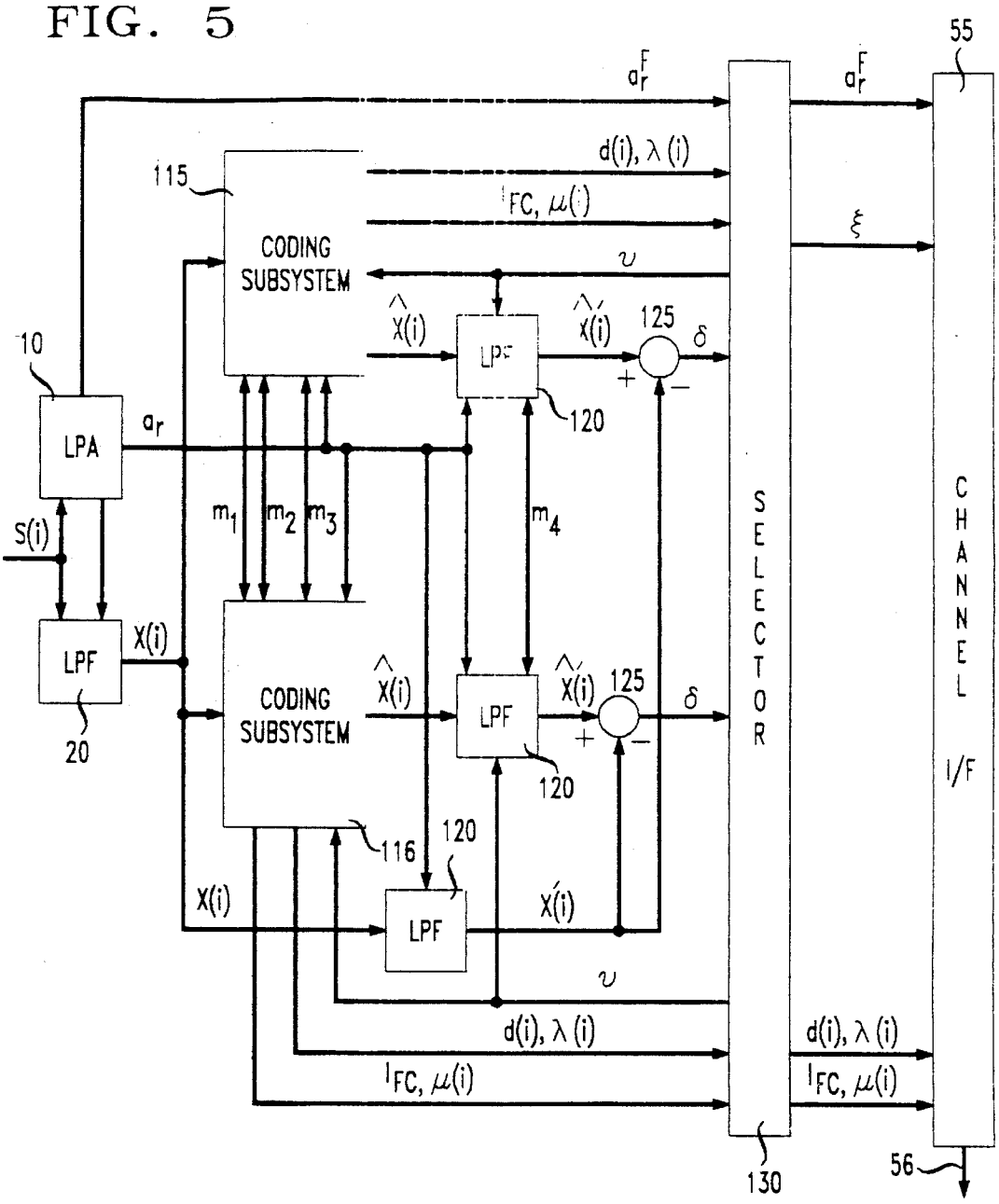
FIG. 5 presents a second illustrative embodiment of the present invention.

A second illustrative embodiment of the present invention is presented in FIG. 5. Like the first embodiment described above, this embodiment may employ the channel fore, at presented in FIG. 3 and may communicate with the receiver presented in FIG. 4. Unlike the first embodiment, however, this embodiment does not decide prior to the coding process which subframe of a subframe pair will be coded with use of one coder and which will be coded with use of both coders. Rather, for a given pair of subframes, this illustrative embodiment provides coded alternatives: (i) a first alternative where the first subframe of a pair is coded with both coders, but the second is coded without the second coder; and (if) a second alternative where the first subframe is coded without the second coder, and the second subframe is coded with both coders. The second embodiment then chooses the alternative which results in lower coding error. The parameters (i.e., the coded representation) of the chosen alternative are then provided to a channel interface for communication to a receiver.

As shown in FIG. 5, a linear predictive filter 20 and a linear predictive analyzer 10 receive a sampled speech information signal, s(i). Analyzer 10 and filter 20 are the same devices described above with reference to the first illustrative embodiment. As with the first embodiment, LPA 10 computes linear prediction coefficients, $a_r^F$, valid at frame boundaries, based on signal s(i). Values for $a_r$ valid at the center of subframes within the boundaries ,are determined by conventional interpolation of frame boundary coefficients by LPA 10. The coefficients, at, valid at subframe centers are output to LPF 20, $LPF^{-1}{}_S120$($LPF^{-1}{}_S120$ will be discussed below in connection with the choice of coded alternatives), ACB&S 30, and FSCB search 40. Coefficients, $a_r^F$, valid at frame boundaries are additionally output to selector 130. Subframes of speech information signal x(i) are formed in the conventional manner by LPF 20, as described above for the first illustrative embodiment.

Like the first embodiment, the second embodiment operates on pairs of subframes. In this case, each pair of subframes of x(i) is provided by LPF 20, in parallel, to two coding subsystems 115, 116.

Figure 6:
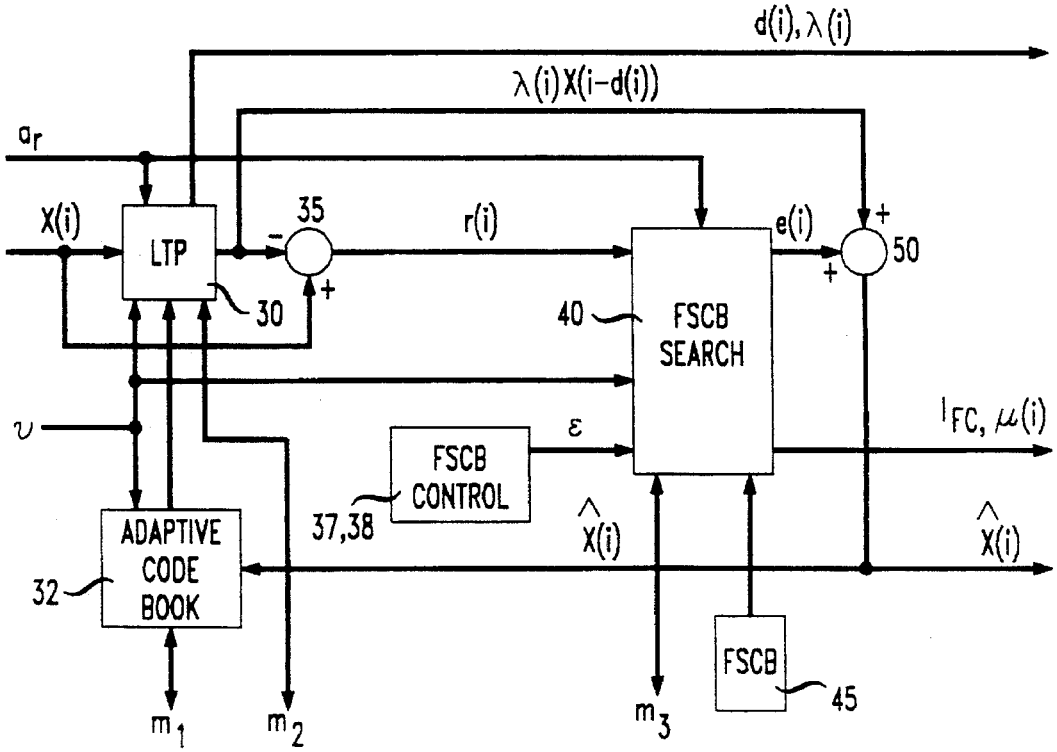
FIG. 6 presents a speech coding subsystem, comprising adaptive and fixed codebooks, for use with the illustrative embodiment of FIG. 5.

Each coding subsystem 115, 116 operates to code the subframes of a subframe pair in a similar manner. As shown in FIG. 6, the subsystems 115, 116 comprise the same coders (an adaptive codebook ACB&S 31, 32 and a FSCB system 40, 45). The difference between these subsystems 115, 116 concerns the way their the coders are applied to the subframes of a given subframe pair. Subsystem 115 codes the first subframe of a subframe pair with use of both coders, and the second subframe without the second coder; subsystem 116 codes the first subframe of the same pair without the second coder, and the second subframe with both coders. Control of subframe coding by the second coder for subsystems 115, 116 is effected by FSCB control 37, 38, respectively, which sets $\epsilon$ such that the appropriate subframe within a pair is always coded for the subsystem 115, 116.

Thus, subsystems 115, 116 provide alternative coded representations of a given subframe pair from which one must be chosen. These alternative representations are provided by coding subsystems 115, 116 to selector 130 as ACB&S delay and gain information, d(i) and $\lambda$ (i), respectively; and FSCB system index and gain information, $I_{FC}$ and $\mu(i)$, respectively. The choice between two coded representations of a subframe pair is based on the amount of coding error introduced by each representation. The amount of coding error introduced by each representation is evaluated by selector 130, in combination with $LPF^{-1}{}_S120$ and subtraction circuits 125.

Referring again to FIG. 5, each coding subsystem 115, 116 provides an estimated speech information signal, $\hat{x}(i)$, which is equal to the speech information signal which would be synthesized by a receiver if it were to receive that subsystem's coded representation of the original speech information signal x(i). The estimated speech information signal $\hat{x}(i)$ from each subsystem 115, 116 may therefore be compared to original speech information signal x(i) to determine a measure of error introduced by the coded representation.

A measure of coding error is provided by forming a difference, $\delta$, between a perceptually weighted original speech information signal, x(i), and a perceptually weighted estimated speech information signal $\hat{x}(i)$ from each coding subsystem, for a pair of subframes. Perceptual weighting is provided by $LPF^{-1}{}_S$ 120 which operate according to the following expression:

$$x'(i) = x(i) + \sum_{r=1}^{R} \gamma a_r x'(i-r), \quad (4)$$

where linear prediction coefficients $a_r$ are valid at the center of the subframe in question, R is the number of coefficients, and $\gamma$ is a perceptual weighting factor (illustratively set to 0.8). Difference signals, $\delta(i)$, are formed by subtraction circuits 125 and represent coding error over a pair of subframes.

The difference signals, $\delta(i)$, are provided to selector 130 for comparison. The selector squares these difference signals, $\delta(i)^2$, to determine error signal energy. These error signal energies are compared to determine which is smaller. The coding subsystem responsible for introducing the smaller error, as represented by the smaller error signal energy, $\delta(i)^2$, is the one chosen to provide the coded representation of the pair of subframes.

As discussed above, both coding subsystems 115, 116 provide their coded representations of a subframe pair to selector 130. Once selector 130 has determined which subsystem 115, 116 will introduce the smaller error by its coded representation, it provides that representation to a channel interface 55 Channel interface 55 is the same as that discussed above with reference to the first illustrative embodiment. Interface 55 packs bits in a format for transmission to a receiver in the fashion discussed above with reference to FIG. 3.

In addition to the coded representation of a subframe pair, selector 130 provides linear prediction coefficients $a_{+}^{h}$ and a subframe select bit, $\xi$, to the interface 55 The linear prediction coefficients $a_{+}^{h}$ are the same as those discussed above with reference to the first embodiment. They are valid at the end of the frame containing the coded subframe pair in question. The subframe select bit, $\xi$, is defined as discussed above with reference to the first illustrative embodiment. Values for the bit are determined based on the particular coding subsystem 115, 116 chosen by selector 130. When coder 115 has been chosen to provide the coded representation for the pair of subframes (i.e., when tile first subframe of a pair has been coded with both coders of subsystem 115), $\xi$ is set equal to 0. When coder 116 has been chosen to provide the coded representation of the pair of subframes (i.e., when the second subframe of a pair has been coded with both coders of subsystem 116), $\xi$ is set equal to 1.

After choosing a coded representation for a pair of subframes of the speech information signal, x(i ), and prior to the coding of the next pair of subframes in a frame of speech information, selector 130 updates the contents of certain memories of the embodiment. It does this by providing an update signal, $\upsilon$, to the adaptive codebooks and searches, 31, 32, and FSCB searches 40 of subsystems 115, 116. Signal $\upsilon$ is also provided to those $LPF^{-1}$ 120 which provide perceptual weighting to the estimated speech information signals, $\hat{x}(i)$, output by tile subsystems 115, 116. The update signal, $\upsilon$, causes the contents of tile adaptive codebook 32, $m_1$, associated with tile subsystem which provided the chosen representation to overwrite the contents of the adaptive codebook 32 of the other subsystem 116, 115. Furthermore, it causes the signal memories of the adaptive codebook search 31, FSCB search 40, and $LPF^{-1}$ 120($m_2$, $m_3$, $m_4$, respectively) which are associated with the chosen representation to overwrite the signal memories of the other adaptive codebook search 31, FSCB search 40 and $LPF^{-1}$ 120 (linear filters operate by summing weighted past values of either or both input and output signals; it is the memory holding these past values—the signal memory—which is overwritten by this process; conventional adaptive codebook search 31 and FSCB search 40 of subsystems 115, 116 also contain inverse LPF filters which are used to assess codebook vector errors (see U.S. patent application Ser. No. 07/782,686, incorporated by reference above)). Illustratively, $\upsilon$ takes on the same values as subframe selection signal, $\xi$. As such, responsive to receiving $\upsilon$, the memories of the system have the information needed ($m_1$, $m_2$, $m_3$, $m_4$) to effect tile correct memory update. After completion of this update process, the coding of tile next pair of subframes in a frame of a speech information signal may occur.

The teachings of the present invention may be applied to still further illustrative embodiments. For example, an embodiment may be provided which comprises a first and a second speech coder and which codes a speech information signal segment using either or both of the speech coders. If these are N signal segments for coding by this embodiment, then tile first coder is applied in the coding of L such segments, and the second coder is applied in the coding of M such segments, where $L+M \geqq N+1$. In this embodiment, each of the N segments is coded with use of at least one of the two coders.

We claim:

1. A method of coding a first signal at a predetermined bit rate, the first signal reflecting speech information and comprising sets of signal segments, each set comprising a plurality of N signal segments, the method comprising the steps of:

a. coding the N signal segments of a set with a first speech coder to provide a first coded representation for each of the N signal segments;

b. for each of one or more of the N signal segments, forming a second signal reflecting speech information not coded by the first speech coder; and c. responsive to a coding criterion, coding a number, M, of second signals with a second speech coder to provide a second coded representation for each of said M second signals, where $1<M<N-1$ and where the number of second signals coded, M, is determined based on the predetermined bit rate;

such that, of said N signal segments, a number, P, of said signal segments are coded with use of the first speech coder, said M signal segments are coded with use of both the first and second speech coders, and wherein $N=P+M$.

2. The method of claim 1 wherein the second signal comprises a residual signal reflecting a difference between a signal segment and said signal segment's quantized representation provided by the first speech coder.

3. The method of claim 1 wherein the step of coding M second signals comprises the step of selecting one or more of the M second signals for additional coding responsive to the coding criterion.

4. The method of claim 3 wherein the step of selecting one or more of the M second signals comprises the step of evaluating a characterizing parameter for each of the N signal segments of the first signal.

5. The method of claim 4 wherein the step of evaluating comprises the step of comparing the characterizing parameter of the second signal's corresponding signal segment with the coding criterion.

6. The method of claim 5 wherein the characterizing parameter comprises signal energy.

7. The method of claim 1 further comprising the step of forming a synthesized signal reflecting speech information for each signal segment for use by the first speech coder in coding subsequent signal segments.

8. The method of claim 1 wherein the step of coding N signal segments with a first speech coder comprises:

a. generating a plurality of modified signal segments based on a signal segment to be coded;

b. coding a modified signal segment to produce a modified signal segment coded representation;

c. synthesizing an estimate of the modified signal segment based on the modified signal segment coded representation;

d. determining an error between the signal segment to be coded and the synthesized estimate of the modified signal segment; and e. selecting as the first coded representation of the signal segment to be coded a particular modified signal segment coded representation based on an error evaluation process.

9. The method of claim 1 wherein the set of signal segments is coded a plurality of times with use of the first and second speech coders to form a plurality of modified coded representations of the set, and wherein a particular modified coded representation is selected to represent the set responsive to the coding criterion.

10. A method of coding a signal at a predetermined bit rate, the signal reflecting speech information and comprising sets of signal segments, each set comprising a plurality of N signal segments, the method comprising the steps of:

a. forming a plurality of trial coded representations of a set of N signal segments, each trial coded representation formed by 1. generating a coded representation of each of M signal segments of the set, which coded representation is generated based on output signals of a first speech coder and a second speech coder, where M is determined based on the predetermined bit rate; and 2. generating a coded representation of each of P other signal segments of the set, which coded representation is based on an output signal of the first speech coder;

where P>0 and M>0 and N=P+M; and b. based on a coding criterion, selecting a particular trial coded representation to represent signal segments.

11. The method of claim 10 wherein the step of selecting comprises the step of determining a characterizing parameter for each trial coded representation.

12. The method of claim 11 wherein the step of selecting further comprises the step of comparing the characterizing parameters of the trial coded representations, and selecting a particular trial coded representation based on the coding criterion.

13. The method of claim 10 wherein the step of generating a coded representation of each of P signal segments comprises, for each such segment, the steps of:

a. generating a plurality of modified signal segments based on a signal segment to be coded;

b. coding a modified signal segment to produce a modified signal segment coded representation;

c. synthesizing an estimate of the modified signal segment based on the modified signal segment coded representation;

d. determining an error between the signal segment to be coded and the synthesized estimate of the modified signal segment; and e. selecting as the coded representation of such signal segment to be coded a particular modified signal segment coded representation having an associated error which satisfies an error evaluation process.

14. An apparatus for coding a first signal at a predetermined bit rate, the first signal reflecting speech information and comprising sets of signal segments, each set comprising a plurality of N signal segments, the apparatus comprising:

a. a first speech coder for coding the N signal segments of a set to provide a first coded representation for each of the N signal segments;

b. means for forming a second signal for each of one or more of the N signal segments, the second signal reflecting speech information not coded by the first speech coder; and c. a second speech coder for coding a number, M, of second signals responsive to coding criterion to provide a second coded representation for each of said M second signals, where $1 \leqq M \leqq N-1$ and where the number of second signals coded, M, is determined based on the predetermined bit rate;

such that, of said N signal segments, a number, P, of said signal segments are coded with use of the first speech coder, said M signal segments are coded with use of both the first and second speech coders, and wherein N=P+M.

15. The apparatus of claim 14 wherein the second signal comprises a residual signal reflecting a difference between a signal segment and said signal segment's quantized representation provided by the first speech coder.

16. The apparatus of claim 14 further comprising an analyzer for selecting one or more of the M second signals for additional coding responsive to the coding criterion.

17. The apparatus of claim 14 wherein the first signal is provided by a linear prediction filter.

18. The apparatus of claim 14 wherein the first speech coder comprises an adaptive codebook vector quantizer.

19. The apparatus of claim 18 wherein tile first speech coder further comprises a linear prediction filter.

20. The apparatus of claim 14 wherein the second speech coder comprises a fixed codebook.

21. An apparatus for coding a signal at a predetermined bit rate, the signal reflecting speech information and comprising sets of signal segments, each set comprising a plurality of N signal segments, the apparatus comprising:

means for forming a plurality of trial coded representations of a set of N signal segments said means for forming comprising:

1. a first speech coder for use in generating a coded representation of each of N signal segments of the set; and 2. a second speech coder for use in generating a coded representation of M signal segments of the set, wherein the coded representation of each of said M segments is generated based on output signals of the first and second speech coders;

where 0<M<N and where M is determined based on the predetermined bit rate; and b. means for selecting a trial coded representation to represent the set of signal segments based on a coding criterion; and wherein, of said N signal segments, a number, P, of said signal segments are coded with use of the first speech coder and wherein N=P+M.

22. A method of coding a signal at a predetermined bit rate with use of at least two speech coders, the signal reflecting speech information and comprising sets of signal segments, each set comprising a plurality of N signal segments, the method comprising the steps of:

a. generating a coded representation of L of the N signal segments with use of a first speech coder; and b. generating a coded representation of K of the N signal segments with use of a second speech coder:

wherein

1. $L>0$ and $K>0$ such that $L+K \geqq N+1$ and $L+K<2N$;
2. the coded representation of $L+K-N$ segments is based on output signals of said first and second speech coders; and
3. a quantity $L+K-N$ is determined based on the predetermined bit rate.

* * * * *